US010493310B2

(12) United States Patent
King

(10) Patent No.: US 10,493,310 B2
(45) Date of Patent: Dec. 3, 2019

(54) EXERCISE MACHINE HAVING FLUID CONTAINER WITH ADJUSTABLE WATER LEVELS

(71) Applicant: WATER ROWER (UK) LTD, London (GB)

(72) Inventor: Peter King, Warren, RI (US)

(73) Assignee: WATER ROWER (UK) LTD, London (GB)

( * ) Notice: Subject to any disclaimer, the term of this patent is extended or adjusted under 35 U.S.C. 154(b) by 309 days.

(21) Appl. No.: 15/326,941

(22) PCT Filed: Jul. 16, 2015

(86) PCT No.: PCT/GB2015/052060
§ 371 (c)(1),
(2) Date: Jan. 17, 2017

(87) PCT Pub. No.: WO2016/009213
PCT Pub. Date: Jan. 21, 2016

(65) Prior Publication Data

US 2017/0209729 A1 Jul. 27, 2017

Related U.S. Application Data

(60) Provisional application No. 62/025,787, filed on Jul. 17, 2014.

(51) Int. Cl.
*A63B 21/008* (2006.01)
*A63B 21/00* (2006.01)
(Continued)

(52) U.S. Cl.
CPC .... *A63B 21/0084* (2013.01); *A63B 21/00069* (2013.01); *A63B 21/151* (2013.01);
(Continued)

(58) Field of Classification Search
None
See application file for complete search history.

(56) References Cited

U.S. PATENT DOCUMENTS 2,725,231 A * 11/1955 Hoover ..... A63B 21/153 482/112
4,723,774 A * 2/1988 Monforte ..... A63B 22/0076 482/112

(Continued)

FOREIGN PATENT DOCUMENTS

WO 2013130114 A1 9/2013

OTHER PUBLICATIONS

International Search Report and Written Opinion dated Oct. 7, 2015, prepared by Stephane Vasin, Authorized Officer of the European Patent Office, in corresponding PCT Patent Application No. PCT/GB2015/052060.

*Primary Examiner* — Stephen R Crow
(74) *Attorney, Agent, or Firm* — Locke Lord LLP; Daniel J. Fiorello

(57) ABSTRACT

An exercise machine assembly provides a fluid-based resistance force and allows a user to exert a force against the resistance force. A fluid displacement device is coupled to the exercise machine assembly and rotatably driven by the force exerted by the user. A fluid container has a hollow body enclosing the fluid displacement device, allowing for the fluid displacement device to rotate therein, and encloses a fluid. The fluid container includes an inner reservoir and an outer reservoir that cause the fluid-based resistance force to vary based on amounts of fluid in the inner and outer reservoirs, respectively. Further, the inner reservoir has one or more openings through which fluid can flow from either of the inner reservoir or the outer reservoir to the other.

19 Claims, 14 Drawing Sheets

(51) Int. Cl.
*A63B 23/02* (2006.01)
*A63B 23/035* (2006.01)
*A63B 23/12* (2006.01)
*A63B 24/00* (2006.01)

(52) U.S. Cl.
CPC ..... *A63B 21/154* (2013.01); *A63B 21/4031* (2015.10); *A63B 21/4035* (2015.10); *A63B 21/4045* (2015.10); *A63B 23/0222* (2013.01); *A63B 23/03575* (2013.01); *A63B 23/03583* (2013.01); *A63B 23/1263* (2013.01); *A63B 24/0087* (2013.01); *A63B 2225/50* (2013.01)

(56) References Cited

U.S. PATENT DOCUMENTS 4,743,011 A * 5/1988 Coffey ..... A63B 21/0088 482/111
4,884,800 A * 12/1989 Duke ..... A63B 21/154 482/73
5,037,088 A * 8/1991 Bernstein ..... A63B 21/0004 482/112
5,110,118 A 5/1992 Winey
5,290,212 A * 3/1994 Metcalf ..... A63B 21/0088 482/111
5,944,637 A * 8/1999 Stickler ..... A63B 69/16 482/112
6,561,955 B1 * 5/2003 Dreissigacker .. A63B 21/00069 482/51
7,329,212 B2 * 2/2008 Roque ..... A63B 15/00 482/110
7,628,739 B2 * 12/2009 Gearon ..... A63B 22/0007 188/290
7,862,484 B1 * 1/2011 Coffey ..... A63B 21/157 482/72
8,708,867 B2 * 4/2014 Lumsden ..... A63B 22/0076 482/71
10,155,131 B2 * 12/2018 Machovina ..... A63B 22/0076
2005/0014611 A1 1/2005 Gearon

* cited by examiner

SEAT-SIDE VIEW

TOP VIEW

SIDE VIEW

FLOW CONFIGURAGTION: 1

FLOW CONFIGURAGTION: 2

FLOW CONFIGURAGTION: 3

FLOW CONFIGURAGTION: 4

EXERCISE MACHINE HAVING FLUID CONTAINER WITH ADJUSTABLE WATER LEVELS

BACKGROUND (a) Field of the Invention

The present invention relates generally to exercise equipment, and more particularly, to an exercise machine having a fluid container with adjustable water levels.

(b) Description of the Related Art

In recent years, the health and wellness industry has seen a dramatic increase in the popularity of exercise equipment. At the same time, exercise equipment that accurately simulates a given physical activity has grown particularly popular. This way, a user may exercise within the comforts and convenience of a gym, or even in one's own home, while achieving an experience that parallels that of an actual sport and/or activity. To this point, many rowers prefer rowing machines which employ a fluid-based resistance force, as it more closely simulates the action of rowing on actual water. By using fluid, rather than a weight-based resistance, a fluid connection is created between the rower and the fluid, typically via a paddle-like object immersed in the fluid. As a result, contact between the paddle face and the fluid acts to dampen out any mechanical feel. Further, by adjusting the volume of fluid in the tank of such a rowing machine, additional simulated effects can be achieved, such as being in a lighter or heavier boat, or changing the gearing of the boat (e.g., the pivot point or mechanical advantage provided by the oar).

SUMMARY

According to the present invention, an exercise machine assembly is configured to provide a fluid-based resistance force and allow a user to exert a force against the resistance force, where the exercise machine assembly includes: a fluid displacement device coupled to the exercise machine assembly and configured to be rotatably driven by the force exerted by the user; and a fluid container having a hollow body enclosing the fluid displacement device, allowing for the fluid displacement device to rotate therein, and configured to enclose a fluid, the fluid container including an inner reservoir and an outer reservoir that cause the fluid-based resistance force to vary based on an amount of fluid in the inner reservoir and an amount of fluid in the outer reservoir, and the inner reservoir having one or more openings through which fluid can flow from either of the inner reservoir or the outer reservoir to the other, wherein during operation of the exercise machine assembly, the fluid displacement device displaces fluid in the outer reservoir, causing the fluid in the outer reservoir to separate from the inner reservoir, such that the fluid cannot flow from the outer reservoir to the inner reservoir. The exercise machine assembly can include an adjustment assembly that regulates fluid flow from either of the inner reservoir or the outer reservoir to the other. The adjustment assembly can establish a plurality of resistance levels by causing predefined amounts of fluid to flow from either of the inner reservoir or the outer reservoir to the other. The adjustment assembly can be configured to: i) allow all fluid in the inner reservoir to flow to the outer reservoir, ii) allow some, but not all, fluid in the inner reservoir to flow to the outer reservoir, and iii) disallow any fluid in the inner reservoir to flow to the outer reservoir. Further, the adjustment assembly can include an adjustment input device configured to receive an adjustment input and cause fluid to flow from either of the inner reservoir or the outer reservoir to the other based on the adjustment input. The adjustment input device can be further configured to accept the adjustment input from a user. Also, the adjustment input device can include an adjustment knob. The adjustment assembly can further include an adjustment gate positioned substantially within the inner reservoir and configured to adjustably open or close any of the one or more openings. The adjustment gate can be further configured to form a plurality of distinct flow configurations, each flow configuration representing a specific arrangement of the one or more openings being either opened or closed. The adjustment assembly can also include an adjustment input device coupled to the adjustment gate, the adjustment input device being configured to receive an adjustment input and adjust the adjustment gate based on the adjustment input. In addition, the adjustment assembly can include an adjustment rod coupled to the adjustment gate and configured to rotatably drive the adjustment gate, the rotation of the adjustment gate determining whether any of the one or more openings are opened or closed. The adjustment assembly can further include a hollow fluid displacement device shaft that is connected to the fluid displacement device, and the adjustment rod can longitudinally traverse an interior of the fluid displacement device shaft. Moreover, the adjustment assembly can include an adjustment input device coupled to the adjustment rod, the adjustment input device being configured to receive an adjustment input and rotatably drive the adjustment rod based on the adjustment input, thereby causing the rotation of the adjustment gate. Further, according to the exercise machine assembly, the fluid container and the fluid displacement device can be horizontally oriented with respect to the exercise machine assembly. Even further, the fluid displacement device can include a paddle. Yet even further, the exercise machine assembly can include a rowing machine.

Further, according to the present invention, a method includes: providing an exercise machine assembly configured to provide a fluid-based resistance force and allow a user to exert a force against the resistance force, the exercise machine including: i) a fluid displacement device coupled to the exercise machine assembly and configured to be rotatably driven by the force exerted by the user, and ii) a fluid container having a hollow body enclosing the fluid displacement device, allowing for the fluid displacement device to rotate therein, and configured to enclose a fluid; receiving an adjustment input at an adjustment input device, the adjustment input indicating a desired resistance level; and in response to the adjustment input, causing fluid to flow from an inner reservoir in the fluid container to an outer reservoir in the fluid container through one or more openings formed in the inner reservoir so as to achieve the desired resistance level, wherein during operation of the exercise machine assembly, the fluid displacement device displaces fluid in the outer reservoir, causing the fluid in the outer reservoir to separate from the inner reservoir, such that the fluid cannot flow from the outer reservoir to the inner reservoir.

BRIEF DESCRIPTION OF THE DRAWINGS

The foregoing and other objects, features, aspects and advantages of the embodiments disclosed herein will become more apparent from the following detailed description when taken in conjunction with the following accompanying drawings.

It should be understood that the above-referenced drawings are not necessarily to scale, presenting a somewhat simplified representation of various preferred features illustrative of the basic principles of the disclosure. The specific design features of the present disclosure, including, for example, specific dimensions, orientations, locations, and shapes, will be determined in part by the particular intended application and use environment.

DETAILED DESCRIPTION OF THE EMBODIMENTS

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Figure 1:
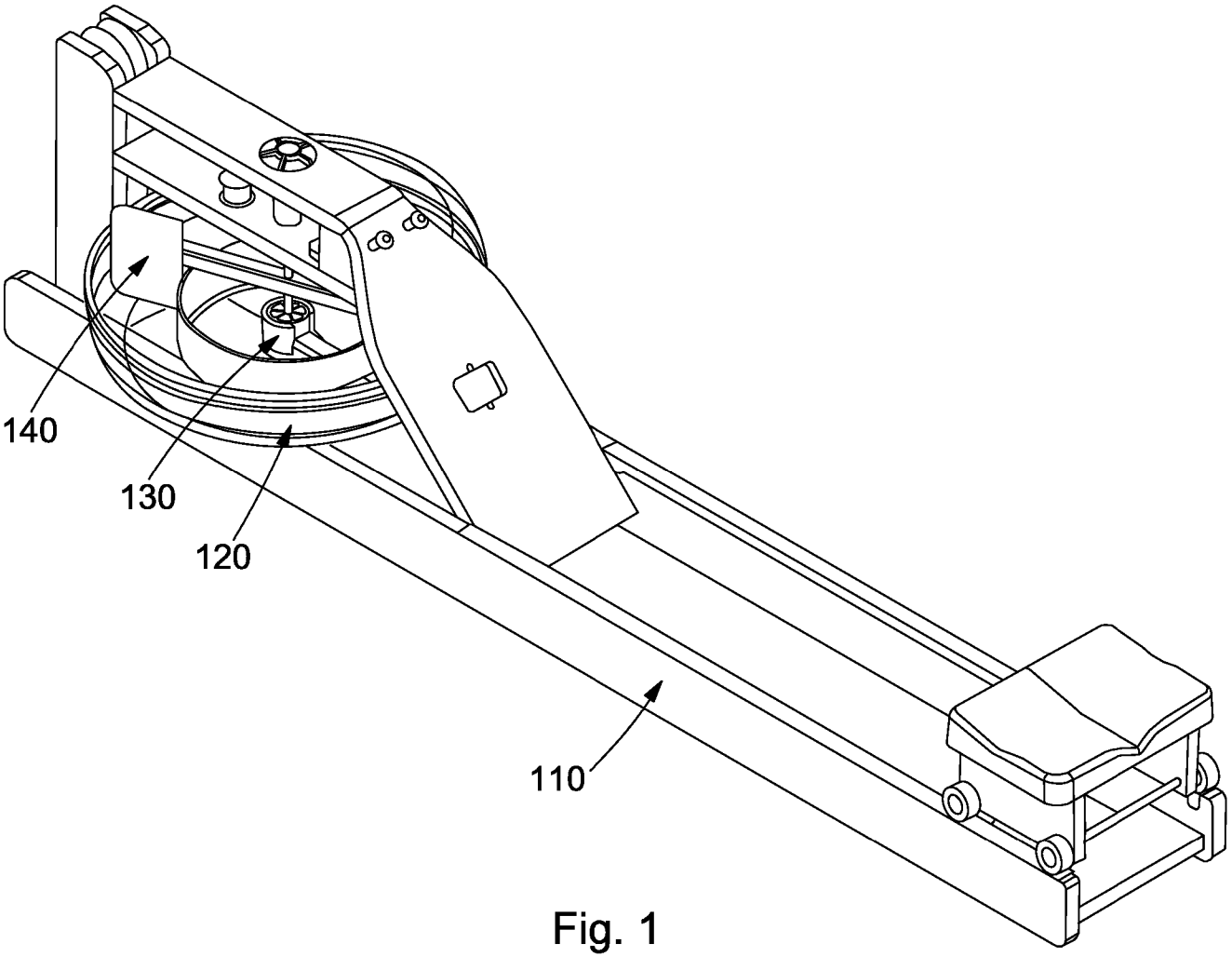
FIG. 1 illustrates an exemplary exercise machine assembly according to an embodiment of the present invention.

FIG. 1 illustrates an exemplary exercise machine assembly according to an embodiment of the present invention. As shown in FIG. 1, the exercise machine assembly 100 includes a frame 110, a hollow fluid container 120, adjustment assembly 130, and fluid displacement device 140. Illustratively, the exercise machine assembly 100 includes a typical rowing machine. Notably however, the applicability of the system and techniques disclosed herein is not limited to rowing machines, as the disclosed embodiments may be applied to any resistance-based exercise machine, particularly those which provide resistance via a supply of fluid. Therefore, the exercise machine assembly 100 is not necessarily limited to a rowing machine, but may incorporate other types of exercise machines where fluid-based resistance is provided and a user is allowed to exert a force against the resistance force, thereby achieving a workout.

In the exercise machine assembly 100 depicted in FIG. 1, a rowing machine can be organized about a frame 110 that mounts a hollow fluid container 120 holding a supply of fluid, e.g., water or the like. A fluid displacement device 140, e.g., a paddle or the like, may be rotatably mounted in the fluid container 120 and coupled, e.g., through a double spool and a clutch, to a drive cord and a recoil mechanism of the exercise machine assembly 100 (not shown). The fluid displacement device 140 may be oriented to displace the fluid in the fluid container 120 by rotating the fluid about the major axis of the fluid container 120 in response to a force exerted by the user (e.g., a pulling movement on the drive cord). As a result, the mass of the spinning fluid can produce a momentum effect, and turbulence generated in the fluid can provide the desired resistance. Resistance is also generated by drag resulting from the fluid moving along the interior surface of the fluid container 120. Thus, by increasing the speed of the fluid displacement device 140, thereby increasing the speed of the fluid being displaced, the drag and resulting resistance is also increased.

The fluid container 120 may include a hollow body enclosing the fluid displacement device 140, allowing the fluid displacement device 140 to rotate therein. The fluid container 120 may have a generally cylindrical construction, allowing for fluid to be displaced by the fluid displacement device 140 in a consistent and continuous manner. The fluid container 120 may be designed to contain any amount of fluid depending on the design of the exercise machine assembly 100 (roughly 20 liters is a standard fluid container volume for rowing machines).

Further, the fluid container 120 may include an inner reservoir and an outer reservoir that cause the fluid-based resistance force provided by the exercise machine assembly 100 to vary based on an amount of fluid in the inner reservoir and an amount of fluid in the outer reservoir, as described further below. Notably, by adjusting the volume of fluid in the fluid container 120, and particularly the inner and outer reservoirs, additional simulated effects can be achieved, such as being in a lighter or heavier boat, or changing the gearing of the boat (e.g., the pivot point or mechanical advantage provided by the oar).

The exercise machine assembly 100 may additionally include an adjustment assembly 130. The adjustment assembly 130 may regulate fluid flow from either of the inner reservoir or the outer reservoir to the other. More specifically, the adjustment assembly 130 may establish a plurality of resistance levels by causing predefined amounts of fluid to flow from either of the inner reservoir or the outer reservoir to the other. To this end, the adjustment assembly 130 may be configured to: i) allow all fluid in the inner reservoir to flow to the outer reservoir, ii) allow some, but not all, fluid in the inner reservoir to flow to the outer reservoir, and iii) disallow any fluid in the inner reservoir to flow to the outer reservoir. Further, the adjustment assembly 130 may comprise various components that allow the fluid levels in the inner and outer reservoir to be changed, including one or more of: the fluid displacement device 140, an adjustment gate, an adjustment rod, and an adjustment input device, as described further below.

Figure 2A:
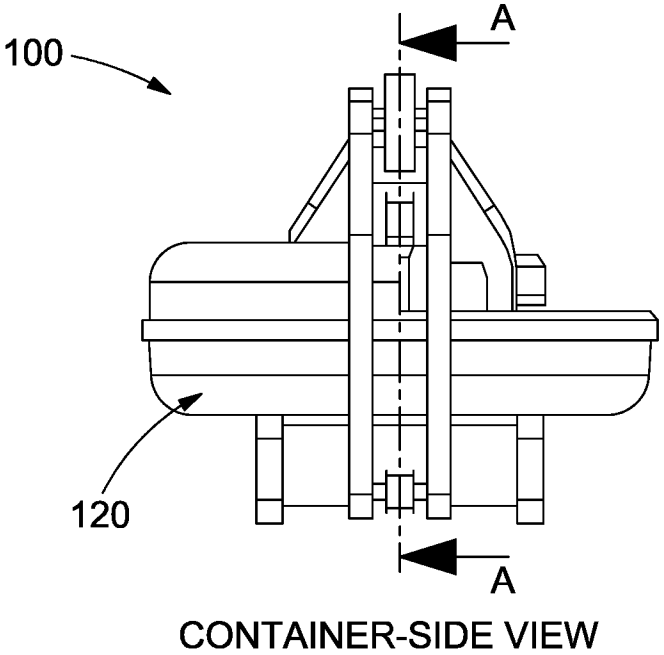
FIGS. 2A-2C illustrate perspective views of the exemplary exercise machine assembly according to an embodiment of the present invention.
Figure 2B:
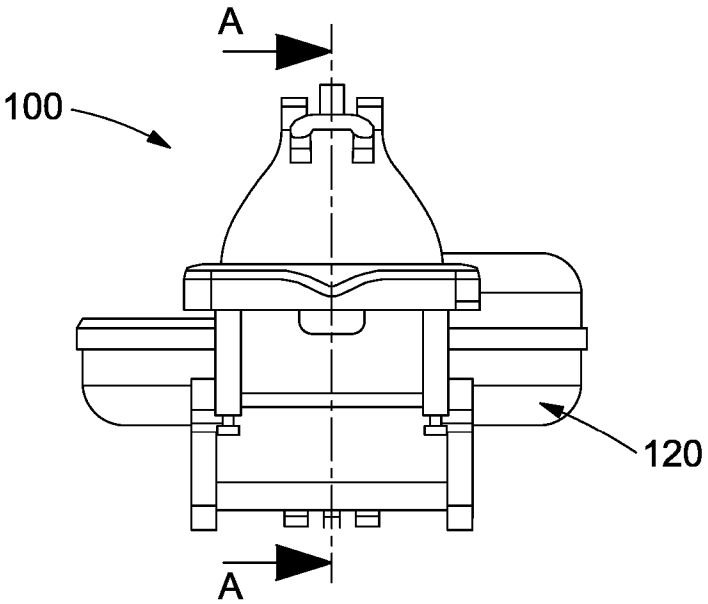
Figure 2C:
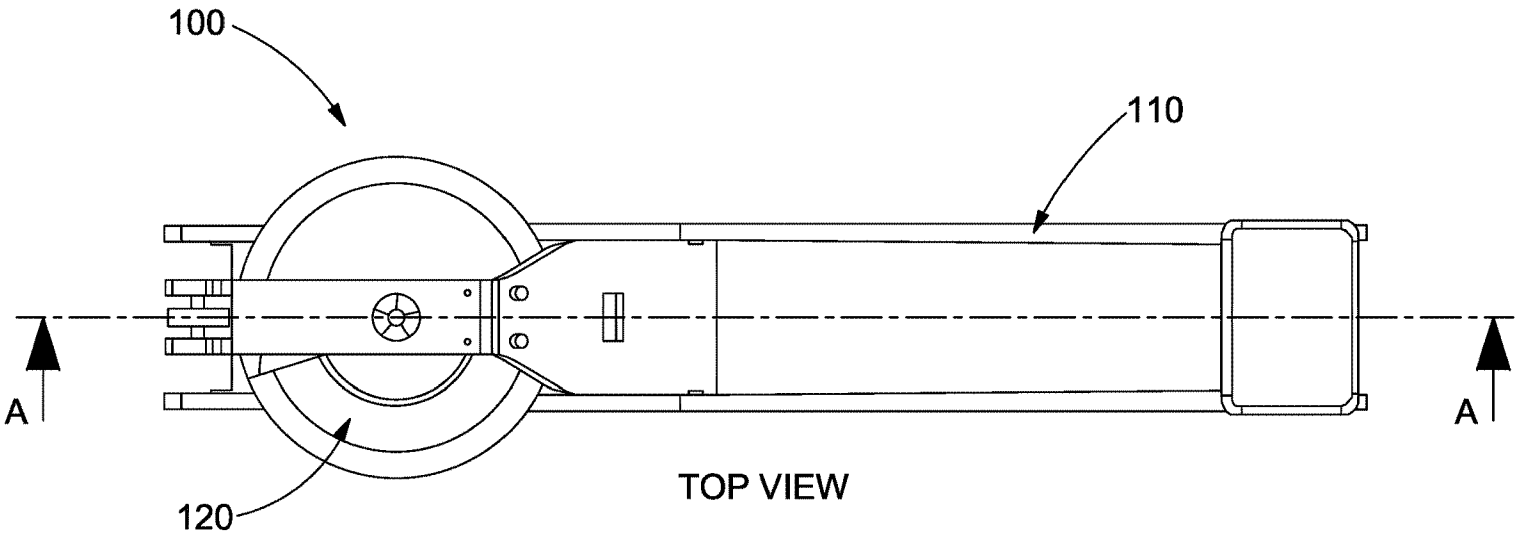

FIGS. 2A-2C illustrate perspective views of the exemplary exercise machine assembly according to an embodiment of the present invention. In particular, FIGS. 2A, 2B, and 2C illustrate a fluid container-side view, seat-side view, and top view, respectively, of the exercise machine assembly 100. As shown in FIGS. 2A-2C, a cross-sectional view line A is depicted as bisecting the exercise machine assembly 100 in a longitudinal direction.

Figure 3:
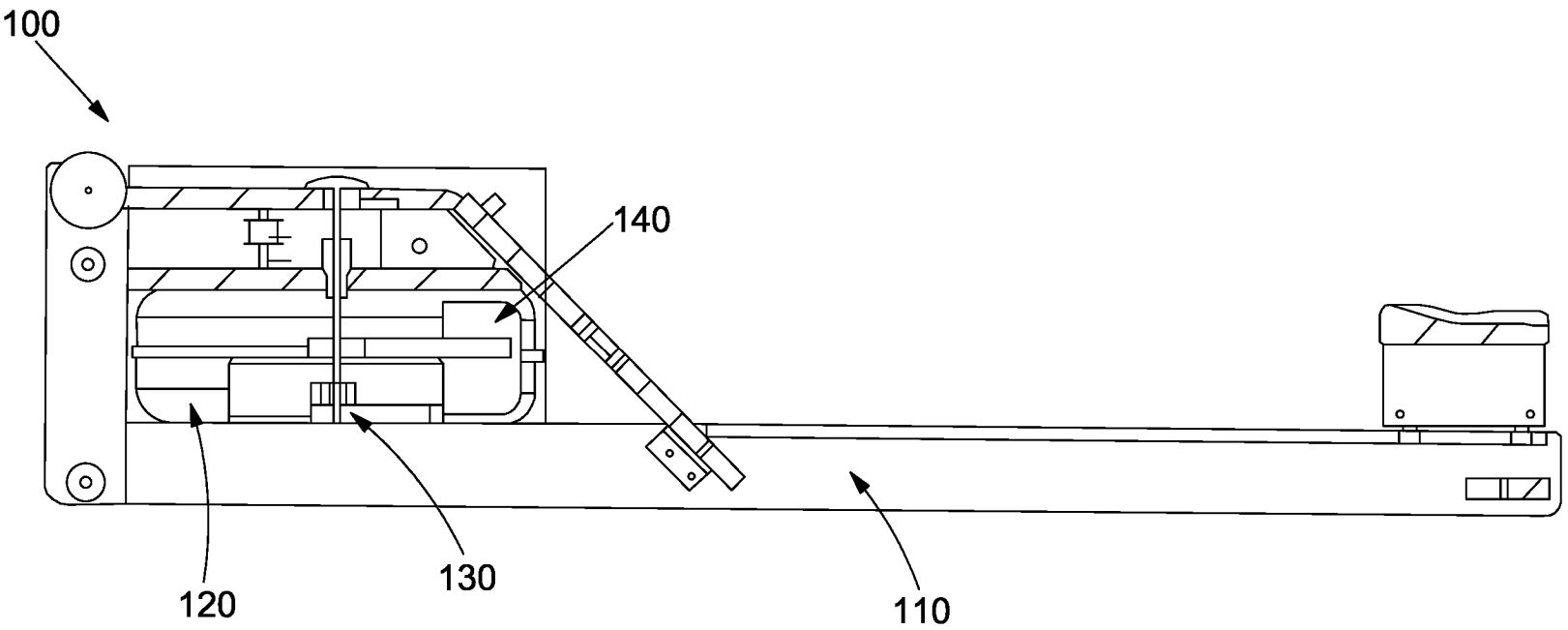
FIG. 3 illustrates a cross-sectional side view of the exemplary exercise machine assembly according to an embodiment of the present invention.

FIG. 3 illustrates a cross-sectional side view of the exemplary exercise machine assembly according to an embodiment of the present invention. The exercise machine assembly 100, as depicted in FIG. 3, is shown from the perspective of cross-sectional view line A. As explained above, the exercise machine assembly 100 may include a frame 110, a hollow fluid container 120 mounted to the frame 110, and a fluid displacement device 140 coupled to the exercise machine assembly 100 and enclosed within the fluid container 120. The exercise machine assembly may further include an adjustment assembly 130 including one or more of: the fluid displacement device 140, an adjustment gate, an adjustment rod, and an adjustment input device. Illustratively, the fluid container 120 and fluid displacement device 140 may be oriented horizontally with respect to the exercise machine assembly 100. However, the disclosed embodiments are also applicable to fluid containers and fluid displacement devices that are oriented vertically or otherwise with respect to the exercise machine assembly.

Figure 4:
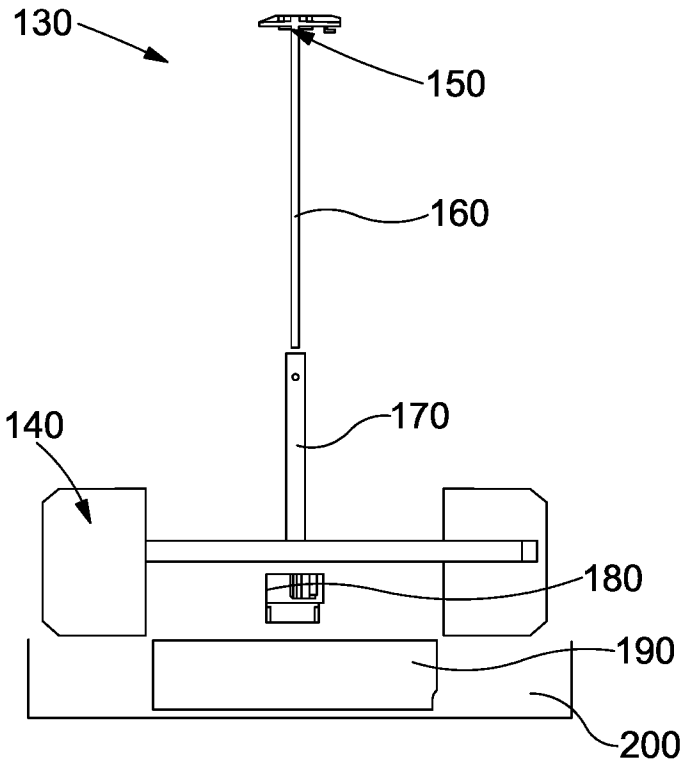
FIG. 4 illustrates a schematic side view of an exemplary adjustment assembly according to an embodiment of the present invention.
Figure 5:
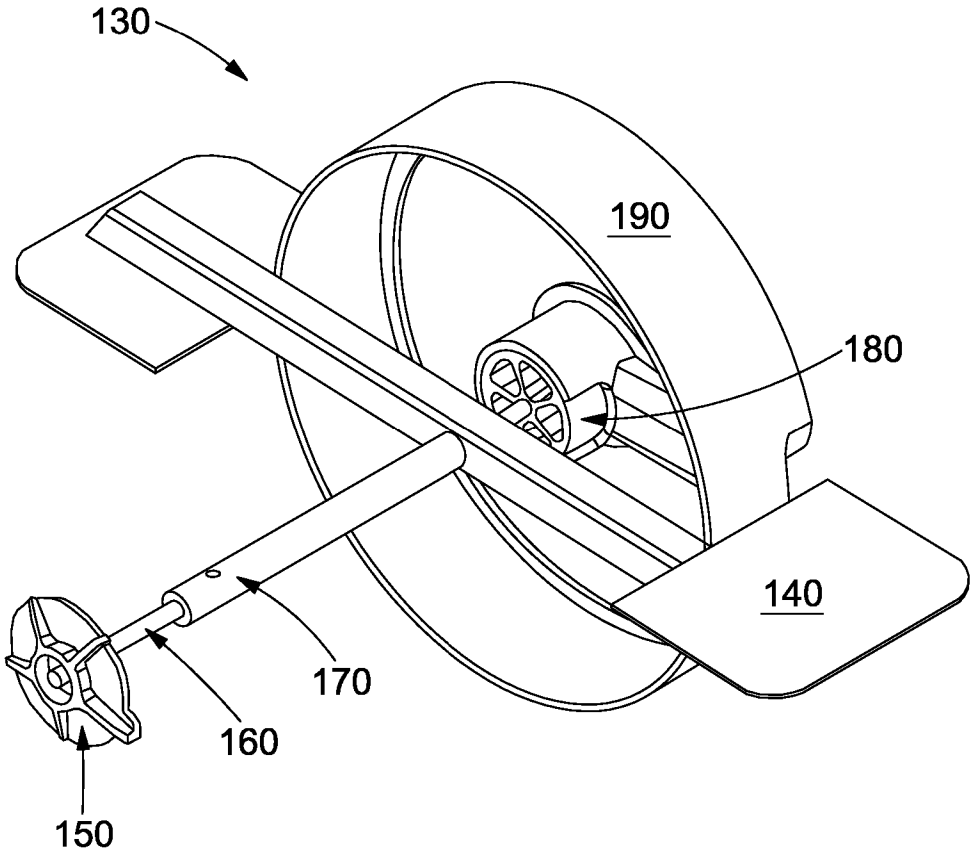
FIG. 5 illustrates a three-dimensional view of the exemplary adjustment assembly according to an embodiment of the present invention.

FIG. 4 illustrates a schematic side view of an exemplary adjustment assembly according to an embodiment of the present invention. Similarly, FIG. 5 illustrates a three-dimensional view of the exemplary adjustment assembly according to an embodiment of the present invention. As shown in FIGS. 4 and 5, the adjustment assembly 130 may include one or more of: the fluid displacement device 140, an adjustment input device 150, an adjustment rod 160, a fluid displacement device shaft 170, and an adjustment gate 180. Further, the adjustment assembly 130 may operate in conjunction with the inner reservoir 190 and outer reservoir 200. The adjustment assembly 130 may regulate fluid flow from either of the inner reservoir 190 or the outer reservoir 200 to the other. More specifically, the adjustment assembly 130 may establish a plurality of resistance levels by causing predefined amounts of fluid to flow from either of the inner reservoir 190 or the outer reservoir 200 to the other. To this end, the adjustment assembly 130 may be configured to: i) allow all fluid in the inner reservoir 190 to flow to the outer reservoir 200, ii) allow some, but not all, fluid in the inner reservoir 190 to flow to the outer reservoir 200, and iii) disallow any fluid in the inner reservoir 190 to flow to the outer reservoir 200.

Operationally, the varying water levels in the inner and outer reservoirs may be achieved by an adjustment input received at the adjustment input device 150. The adjustment input may be received at the adjustment input device 150—and the fluid levels may be changed as a result—at any time (e.g., before, during, or after an exercise session). The adjustment input device 150 may be any device at which an adjustment input, which indicates a level of desired resistance, may be received. For example, the adjustment input device 150 may include an adjustment knob, whereby a user may select a level of resistance at which the user wishes to exercise by turning the adjustment knob accordingly. In this respect, the turning of the adjustment knob may open or close a series of gates in the adjustment gate 180 which either trap or release water from the inner reservoir 190 to the outer reservoir 200. Alternatively, or additionally, the adjustment input device 150 may include an interface comprising buttons, keys, switches, a touchscreen, and so forth, whereby the user may select a level of resistance at which the user wishes to exercise by locally adjusting the resistance settings using the particular adjustment input device interface. Alternatively, or additionally, the adjustment input device 150 may include a signal receiving means (e.g., RF, Bluetooth, Wi-Fi, etc.), whereby the user may select a level of resistance at which the user wishes to exercise by remotely adjusting the resistance settings using a signal transmitting device (e.g., remote control, smart phone, laptop, tablet, etc.).

The adjustment assembly 130 may also include an electrical actuator (not shown) configured to drive the adjustment gate 180. That is, the electrical actuator may be coupled to the adjustment gate 180 and configured to rotatably drive the adjustment gate 180, where the rotation of the adjustment gate 180 determines whether any of the one or more openings are opened or closed. Further, the adjustment input device 150 may be coupled to the electrical actuator, where the adjustment input device 150 is configured to receive the adjustment input and activate the electrical actuator based on the adjustment input, thereby causing the rotation of the adjustment gate 180.

In response to receiving the adjustment input, the adjustment input device 150 can cause fluid to flow from either of the inner reservoir or the outer reservoir to the other based on the adjustment input. To this point, the adjustment input device 150 may be directly or indirectly coupled to the adjustment gate 180, and the adjustment input device 150 may adjust the adjustment gate 180 based on the adjustment input. Further, the adjustment input device 150 may be directly or indirectly coupled to the adjustment rod 160, and the adjustment input device 150 may rotatably drive the adjustment rod 160 based on the adjustment input, thereby causing the adjustment of the adjustment gate 180. The adjustment of the adjustment gate 180 may determine whether any of one or more openings in the inner reservoir 190 are opened or closed, thus regulating the amount of fluid flow, as described further below.

Because the adjustment rod 160 connects the adjustment input device 150 to the adjustment gate 180, the adjustment gate 180 may be externally adjusted, by a user, for example, via the adjustment input device 150. The adjustment rod 160 may extend in a direction that is perpendicular to the bottom surfaces of the inner reservoir 190 and outer reservoir 200. Also, the adjustment rod 160 may longitudinally traverse an interior of the fluid displacement device shaft 170. The fluid displacement device shaft 170 may be hollow and connected to the fluid displacement device 140. As such, the adjustment rod 160 may pass through the fluid displacement device shaft 170, and may rotate in response to an adjustment input at the adjustment input device 150, without interfering with the workings of the user during an exercise session (e.g., while the fluid displacement device 140 is being rotatably driven).

Figure 6A:
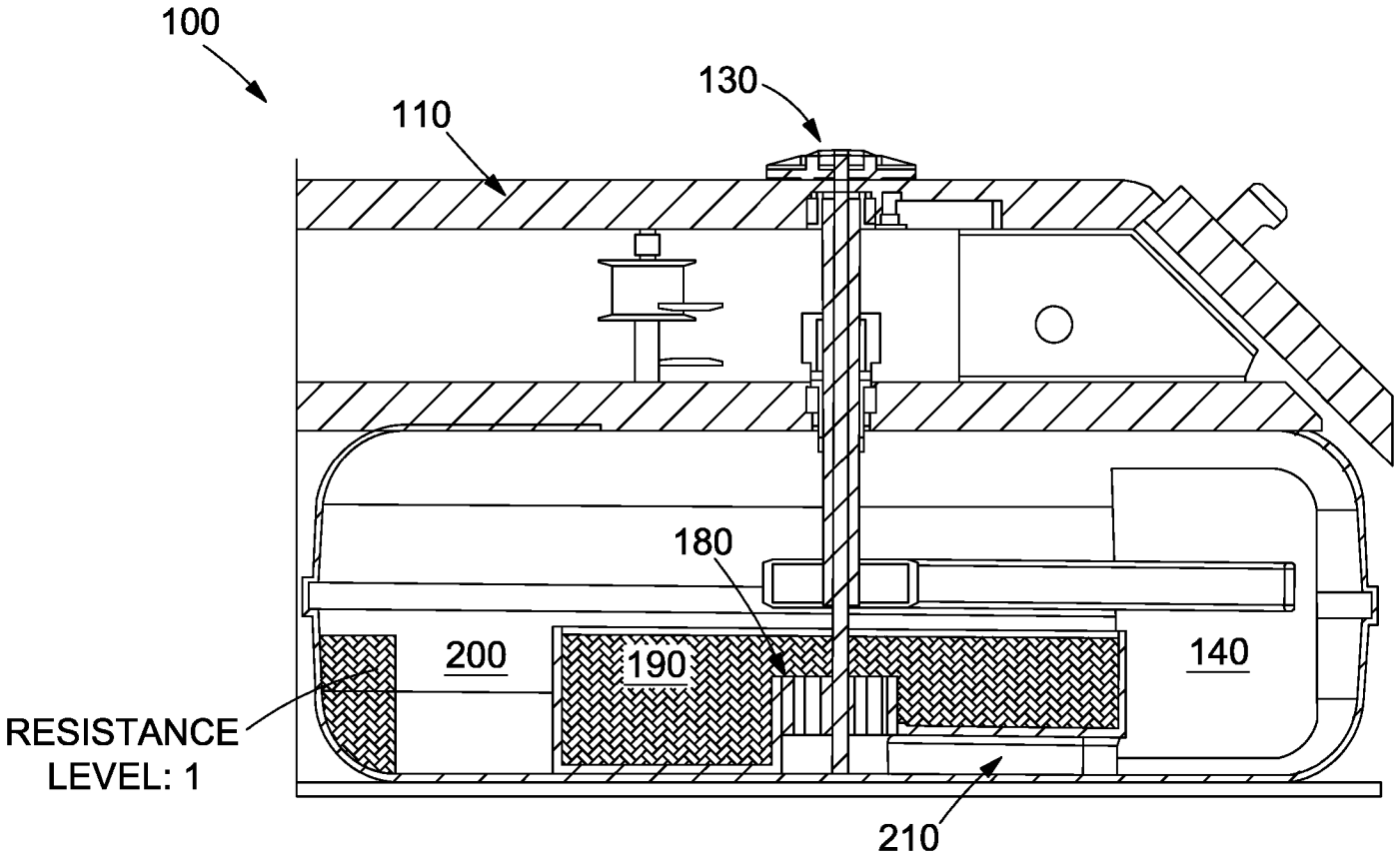
FIGS. 6A-6C illustrate cross-sectional side views of varying fluid levels in an exemplary inner and outer reservoir according to an embodiment of the present invention.
Figure 6B:
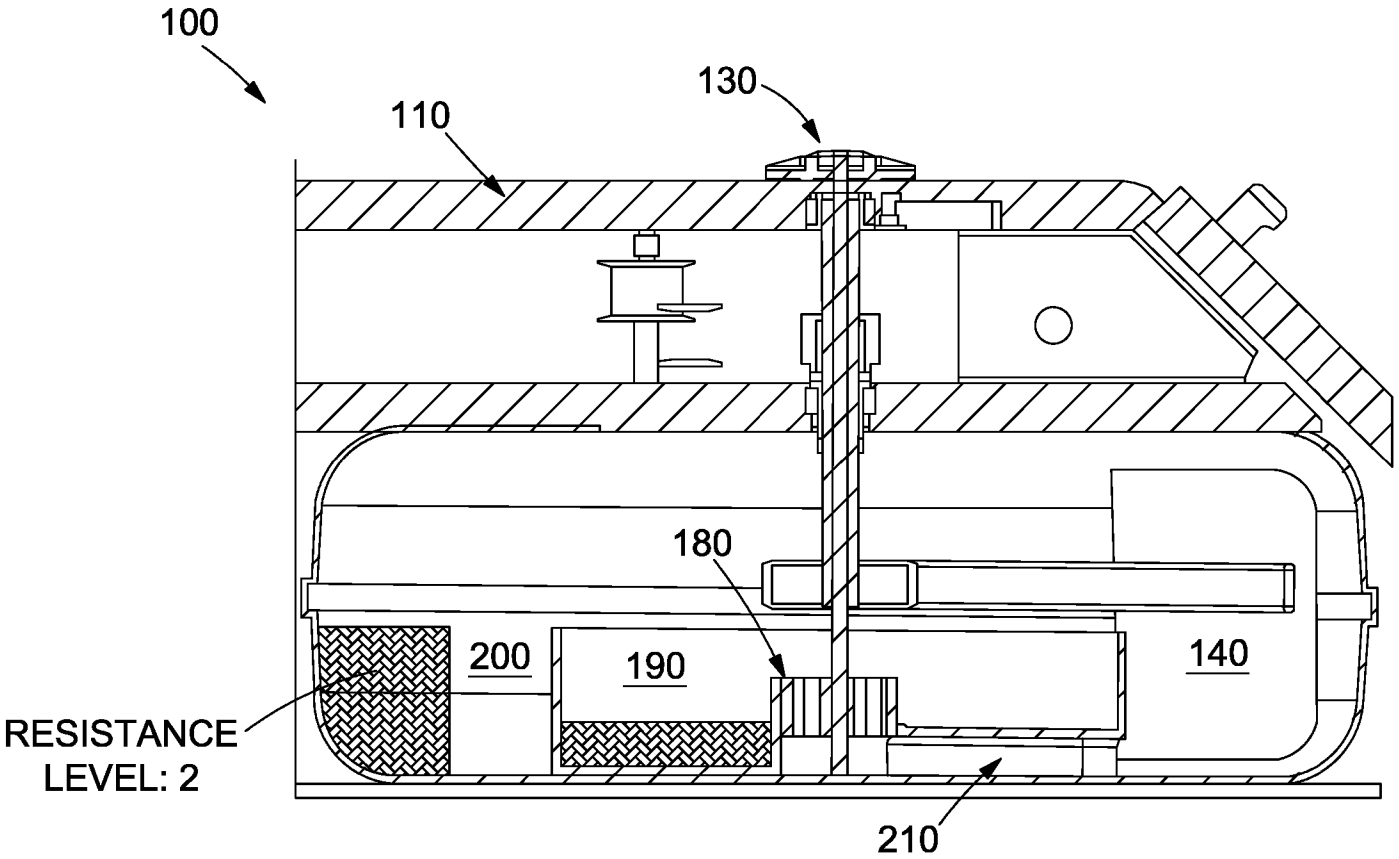
Figure 6C:
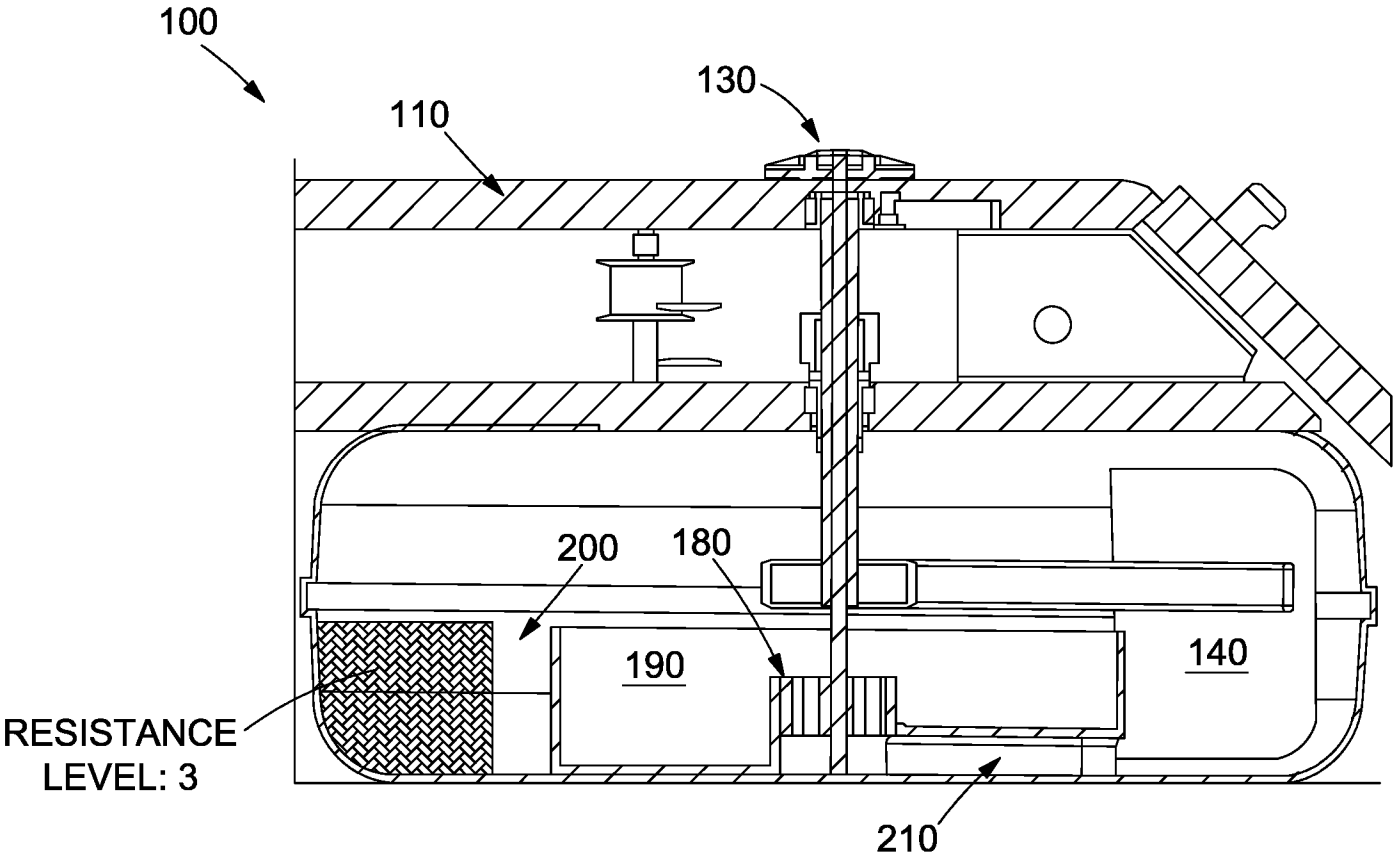

FIGS. 6A-6C illustrate cross-sectional side views of varying fluid levels in an exemplary inner and outer reservoir according to an embodiment of the present invention. In this regard, by causing predefined amounts of fluid to flow from either of the inner reservoir 190 or the outer reservoir 200 to the other, the adjustment assembly 130 can establish a plurality of resistance levels for the user. Illustratively, FIGS. 6A, 6B, and 6C depict exemplary fluid resistance levels of one, two, and three, respectively.

The inner reservoir 190 and the outer reservoir 200, which are located in an interior of the fluid container 120, can cause the fluid-based resistance force generated by the fluid in the fluid container 120 to vary based on an amount of fluid in the inner reservoir 190 and an amount of fluid in the outer reservoir 200. The inner reservoir 190 may hold the fluid that is not required in the outer reservoir 200 for achieving a desired resistance level. The inner reservoir 190 and the outer reservoir 200 may share a passageway 210 through which fluid can flow between the reservoirs, thereby allowing for the fluid levels in the inner reservoir 190 and the outer reservoir 200 to be adjusted. Alternatively, the passageway 210 can be closed, e.g., by adjusting the adjustment gate 180, such that fluid flow between the inner reservoir 190 and the outer reservoir 200 is impeded.

Additionally, the inner reservoir 190 may have one or more openings (shown in FIGS. 7A-7D) through which fluid can flow from either of the inner reservoir 190 or the outer reservoir 200 to the other. The adjustment gate 180 may be adjusted so as to open or close particular openings of the one or more openings, thus allowing predefined amounts of fluid to flow from either of the inner reservoir 190 or the outer reservoir 200 to the other. The adjustment gate 180 and the one or more openings in the inner reservoir 190 may allow for a variety of fluid levels in the inner and outer reservoirs, as well as a variety of corresponding resistance levels. For example, the adjustment assembly 130, and particularly the adjustment gate 180, may be configured to: i) allow all fluid in the inner reservoir 190 to flow to the outer reservoir 200, ii) allow some, but not all, fluid in the inner reservoir 190 to flow to the outer reservoir 200, and iii) disallow any fluid in the inner reservoir 190 to flow to the outer reservoir 200. Accordingly, adjustment of the adjustment assembly 130 in the exercise machine assembly 100 may allow for a plurality of resistance levels to be achieved.

Notably, as the volume of fluid in the outer reservoir 200 increases, the amount of resistance may also increase, as it becomes more difficult for the user to drive the fluid displacement device 140 when it must displace an increased amount of fluid. As shown in FIG. 6A, an example resistance level of one may be achieved by allowing a small amount of fluid to flow from the inner reservoir 190 to the outer reservoir 200. Thus, a relatively small level of resistance may be achieved, since a user may drive the fluid displacement device 140 with relatively little effort. Further, as shown in FIG. 6B, an example resistance level of two may be achieved by allowing a moderate amount of fluid to flow from the inner reservoir 190 to the outer reservoir 200, thereby lowering the fluid level in the inner reservoir 190. Thus, a moderate level of resistance may be achieved, since a user may drive the fluid displacement device 140 with moderate effort. Further yet, as shown in FIG. 6C, an example resistance level of three may be achieved by allowing all fluid in the inner reservoir 190 to flow from the inner reservoir 190 to the outer reservoir 200. Thus, a relatively large level of resistance may be achieved, since a user may drive the fluid displacement device 140 with relatively substantial effort. It should be understood that any variety of resistance levels may be achieved via adjustments of the adjustment assembly 130, based on the particular configuration of the one or more openings in the inner reservoir 190 that allow fluid to flow between the inner and outer reservoirs. Therefore, the resistance levels shown in FIGS. 6A-6C do not limit the disclosed embodiments and are intended for demonstration purposes only.

Additionally, during operation of the exercise machine assembly 100 (e.g., when the user is rotatably driving the fluid displacement device 140), the fluid displacement device 140 may displace fluid in the outer reservoir 200, causing the fluid in the outer reservoir 200 to separate from the inner reservoir 190, as shown in FIGS. 6A-6C. When the fluid in the outer reservoir 200 separates from the inner reservoir 190, fluid cannot flow from the outer reservoir 200 to the inner reservoir 190. Instead, the fluid is pushed against the outer interior surface of the outer reservoir 200, causing the separation between the displaced fluid and the inner reservoir 190. That is, once rotation of the fluid displacement device 140 commences, the fluid in the outer reservoir 200 may centrifuge to the outer diameter of the outer reservoir 200, thus creating a fluid toroid. As such, the configurations depicted in FIGS. 6A-6C take place while the exercise machine assembly 100 is in use, as the fluid in the outer reservoir 200 is shown as centrifuged to the outer diameter of the outer reservoir 200.

Conversely, when the fluid is pushed against the outer interior surface of the outer reservoir 200, causing the separation between the displaced fluid and the inner reservoir 190, fluid may flow from the inner reservoir 190 to the outer reservoir 200 (through the passageway 210, for example). This is, because as the fluid displacement device 140 pushes the fluid against the outer interior surface of the outer reservoir 200, the fluid in the inner reservoir 190 is then allowed to flow outwardly (e.g., to the outer reservoir) toward the empty portion between the outer walls of the inner reservoir 190 and the displaced fluid in the outer reservoir 200. This way, additional resistance can be generated during an exercise session by transferring fluid from the inner reservoir 190 to the available space in the outer reservoir 200.

FIGS. 7A-7D illustrate cross-sectional three-dimensional views of varying flow configurations in an exemplary adjustment gate according to an embodiment of the present invention. As shown in FIGS. 7A-7D, the inner reservoir 190 may have one or more openings 220 through which fluid can flow from either of the inner reservoir 190 or the outer reservoir 200 to the other. The adjustment gate 180 may be positioned substantially within the inner reservoir 190 so as to adjustably open or close any of the one or more openings 220. By doing so, the adjustment gate 180 can be configured to form a plurality of distinct flow configurations, each flow configuration representing a specific arrangement of the one or more openings 220 being either opened or closed.

For example, FIGS. 7A-7D depict four distinct flow configurations, respectively; that is, a particular arrangement of the openings 220 being opened or closed (e.g., "flow configuration") is shown in each of FIGS. 7A-7D. It should be noted that the exercise machine assembly 100 may feature any variety of flow configurations, and the disclosed embodiments are not limited to the flow configurations illustrated in FIGS. 7A-7D. Rather, the illustrative flow configurations are shown for demonstration purposes only. Moreover, the illustrative number and configuration of the one or more openings 220 in the inner reservoir 190 should not be construed as limiting the disclosed embodiments, as any number and/or configuration of openings 220 in the inner reservoir 190 may be utilized in the exercise machine assembly 100.

The one or more openings 220 may be opened or closed based on the positioning of the adjustment gate 180. The position of the adjustment gate 180 may be adjusted at any time (e.g., before, during, or after an exercise session) so as to change the flow configuration, which determines whether each of the openings 220 are opened or closed. As an example, the adjustment gate 180 may be rotatably driven by the adjustment rod 160, such that rotation of the adjustment gate 180 changes the flow configuration of the one or more openings 220. To this end, the adjustment gate 180 may be shaped in such a way that different adjustments of the adjustment gate 180—as determined by the adjustment input received at the adjustment input device 150—open or close a particular arrangement of the one or more openings 220.

The fluid may then flow from one of the inner reservoir 190 and the outer reservoir 200 to the other via the opened openings 220. To this point, the one or more openings 220 may be formed in the outer wall of the inner reservoir 190, such that fluid may flow directly from one of the inner reservoir 190 and the outer reservoir 200 to the other through the openings 220. In the alternative, or in addition, the one or more openings 220 may be formed in an interior portion of the inner reservoir 190 (e.g., as a valve-like mechanism), as illustrated in FIGS. 7A-7D, and the openings 220 may be coupled to a passageway 210 shared by the inner reservoir 190 and the outer reservoir 200. In this case, the fluid may flow through the one or more openings 220 in the inner reservoir 190 and continue through the passageway 210 to the outer reservoir 200, or vice versa.

Figure 7A:
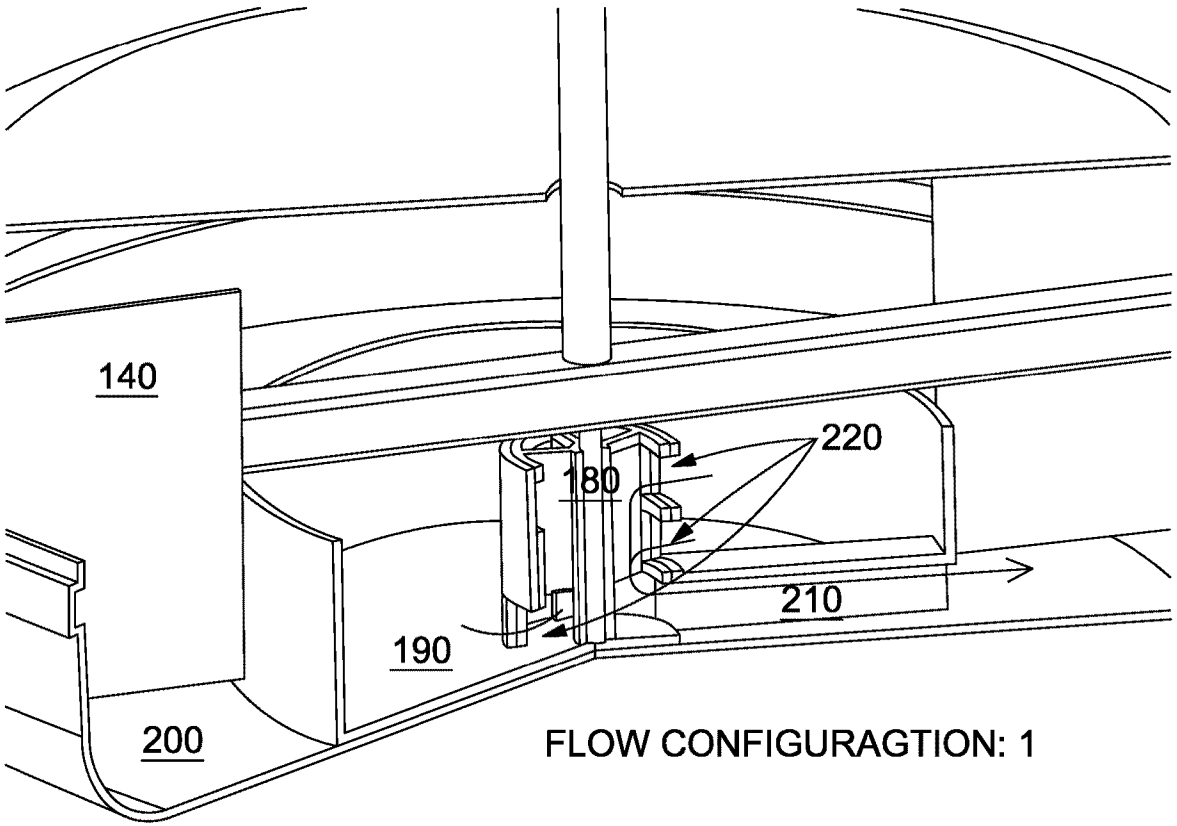
FIGS. 7A-7D illustrate cross-sectional three-dimensional views of varying flow configurations in an exemplary adjustment gate according to an embodiment of the present invention.

As shown in FIG. 7A, the adjustment gate 180 may be adjusted such that a first flow configuration is employed, whereby every opening 220 is open. That is, the adjustment gate 180 may be adjusted such that fluid in the inner reservoir 190 is permitted to flow into the opened openings 220 and through the shared passageway 210 to the outer reservoir. In this flow configuration, because each of the openings 220 is open, an increased amount of fluid is permitted to flow from the inner reservoir 190 to the outer reservoir 200, thus increasing the amount of fluid that resists the fluid displacement device 140.

Figure 7B:
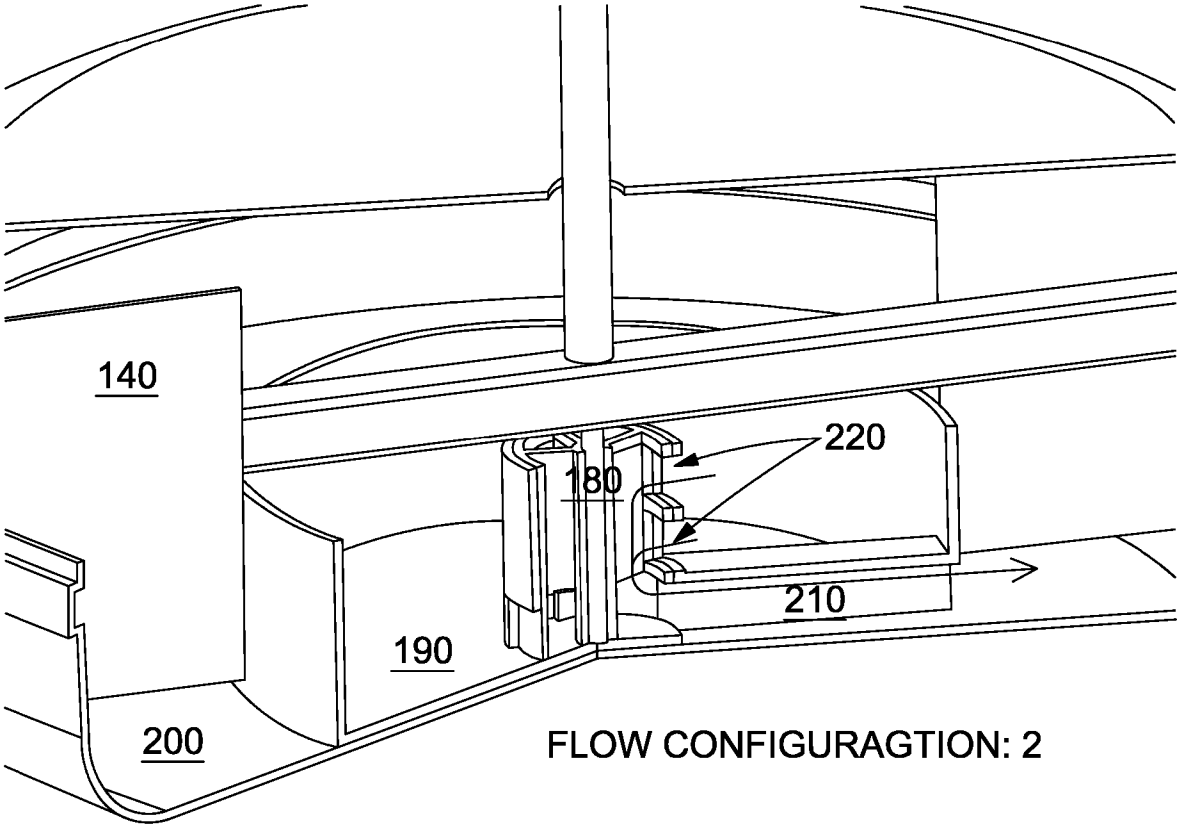

As shown in FIG. 7B, the adjustment gate 180 may be adjusted such that a second flow configuration is employed, whereby two of the three openings 220 are open, while one of the openings 220 is closed. In this flow configuration, because only two of the openings 220 are open, a slightly reduced amount of fluid is permitted to flow from the inner reservoir 190 to the outer reservoir 200, thus providing a slightly reduced amount of fluid that resists the fluid displacement device 140.

Figure 7C:
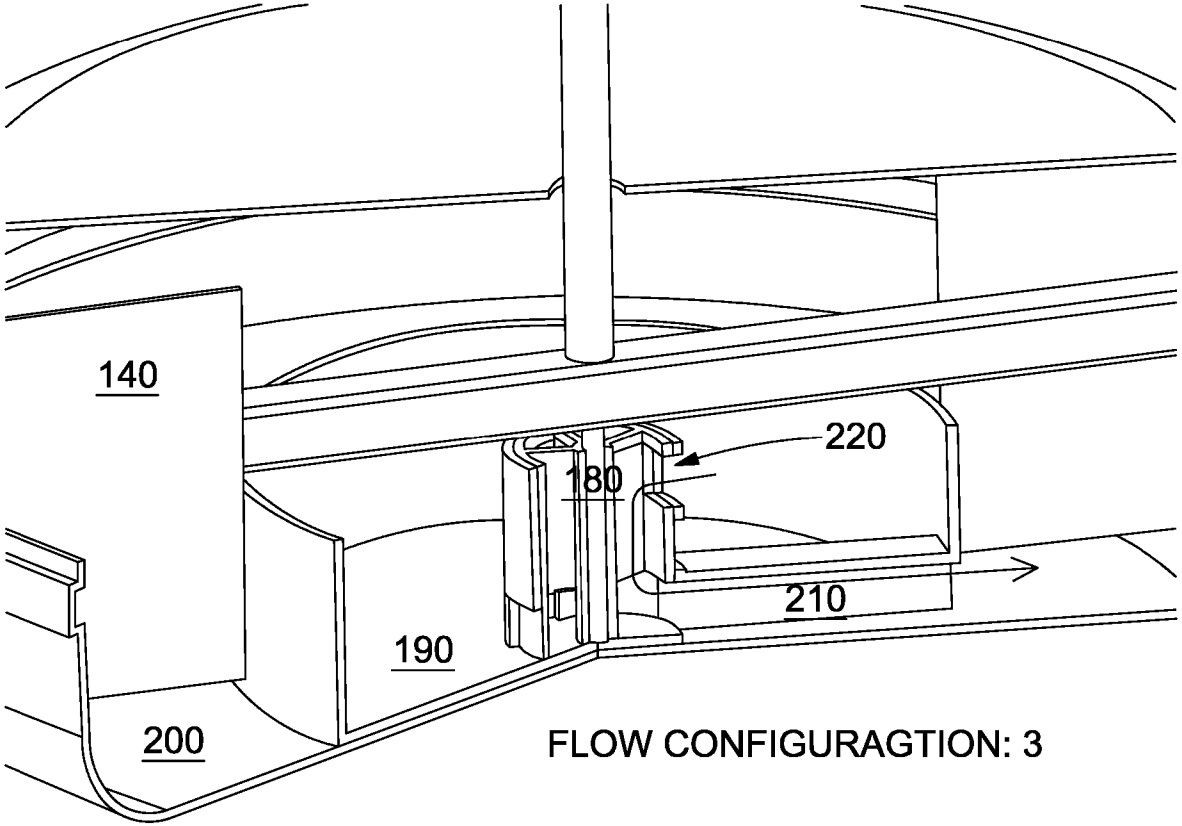

As shown in FIG. 7C, the adjustment gate 180 may be adjusted such that a third flow configuration is employed, whereby one of the three openings 220 are open, while two of the openings 220 are closed. In this flow configuration, because only one of the openings 220 is open, a further reduced amount of fluid is permitted to flow from the inner reservoir 190 to the outer reservoir 200, thus providing a further reduced amount of fluid that resists the fluid displacement device 140.

Figure 7D:
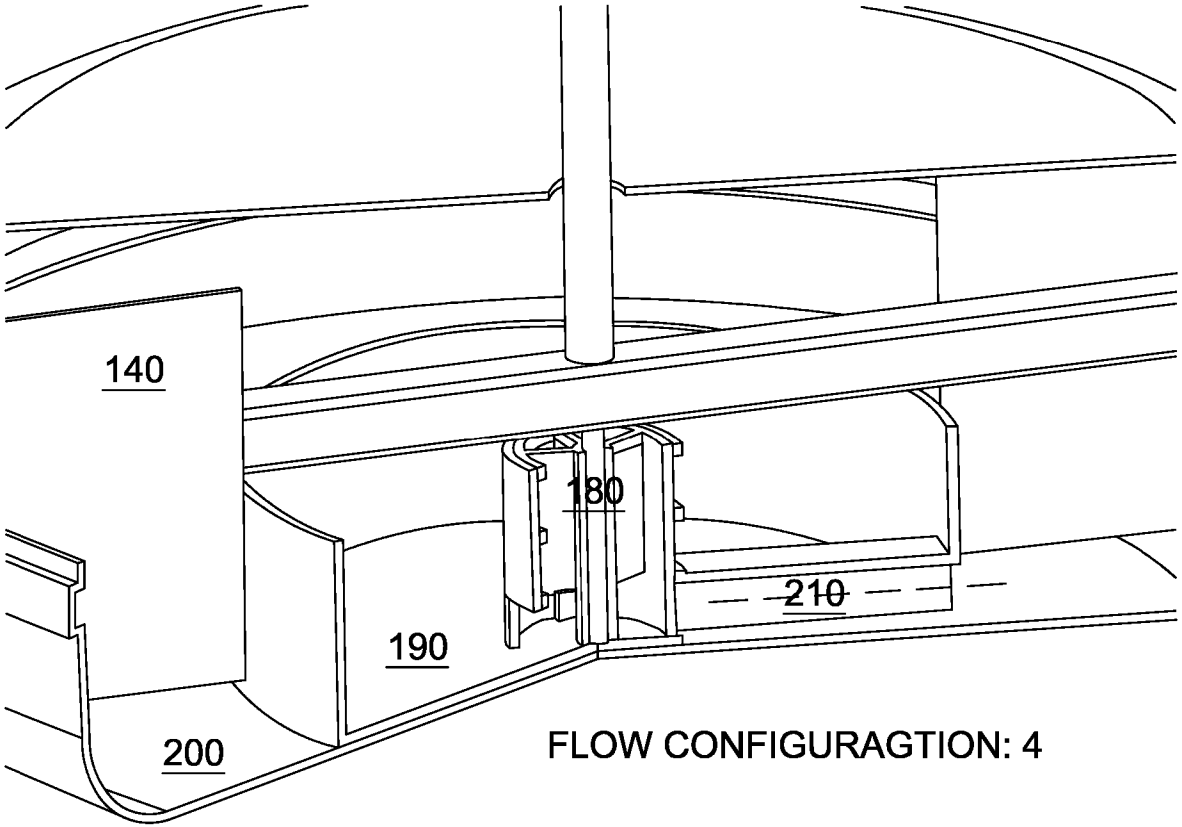

As shown in FIG. 7D, the adjustment gate 180 may be adjusted such that a fourth flow configuration is employed, whereby none of the three openings 220 are open, thus precluding any flow of fluid from the inner reservoir 190 to the outer reservoir 200, or vice versa. In this flow configuration, because none of the openings 220 are open, a further reduced amount of fluid is permitted to flow from the inner reservoir 190 to the outer reservoir 200, thus allowing only the fluid already in the outer reservoir 200 to resist the fluid displacement device 140.

The techniques described herein, therefore, provide for adjustable water levels in an exercise machine fluid container, and as a result, varied levels of resistance during an exercise session. Thus, by providing the ability to change the fluid-based resistance on the fly, the exercise machine assembly offers greater flexibility and a wider range of available workouts, as a user is able to customize the exercise machine according to his or her desired resistance levels.

While there have been shown and described illustrative embodiments that provide for adjustable water levels in an exercise machine fluid container, it is to be understood that various other adaptations and modifications may be made within the spirit and scope of the embodiments herein, with the attainment of some or all of their advantages. For instance, the exercise machine assembly 100 illustratively includes a typical rowing machine, as depicted in the Figures. Notably however, the applicability of the system and techniques disclosed herein is not limited to rowing machines, as the disclosed embodiments may be applied to any resistance-based exercise machine, particularly those which provide resistance via a supply of fluid. Therefore, it is expressly contemplated that the exercise machine assembly may incorporate other types of exercise machines where fluid-based resistance is provided and a user is allowed to exert a force against the resistance force, thereby achieving a workout. Accordingly this description is to be taken only by way of example and not to otherwise limit the scope of the embodiments herein. Therefore, it is the object of the appended claims to cover all such variations and modifications as come within the true spirit and scope of the embodiments herein.

What is claimed is:

1. An exercise machine assembly configured to provide a fluid-based resistance force and allow a user to exert a force against the resistance force, the exercise machine assembly comprising:

a fluid displacement device configured to be rotatably driven by the force exerted by the user; and a fluid container having a hollow body enclosing the fluid displacement device, allowing for the fluid displacement device to rotate therein, and configured to enclose a fluid, the fluid container including an inner reservoir and an outer reservoir that cause the fluid-based resistance force to vary based on an amount of fluid in the inner reservoir and an amount of fluid in the outer reservoir, and the inner reservoir having one or more openings through which fluid can flow from either of the inner reservoir or the outer reservoir to the other, wherein during operation of the exercise machine assembly, the fluid displacement device displaces fluid in the outer reservoir, causing the fluid in the outer reservoir to separate from the inner reservoir, such that the fluid cannot flow from the outer reservoir to the inner reservoir.

2. The exercise machine assembly according to claim 1, further comprising:

an adjustment assembly that regulates fluid flow from either of the inner reservoir or the outer reservoir to the other.

3. The exercise machine assembly according to claim 2, wherein the adjustment assembly establishes a plurality of resistance levels by causing predefined amounts of fluid to flow from either of the inner reservoir or the outer reservoir to the other.

4. The exercise machine assembly according to claim 2, wherein the adjustment assembly is configured to:

i) allow all fluid in the inner reservoir to flow to the outer reservoir, ii) allow some, but not all, fluid in the inner reservoir to flow to the outer reservoir, and iii) disallow any fluid in the inner reservoir to flow to the outer reservoir.

5. The exercise machine assembly according to claim 2, wherein the adjustment assembly includes an adjustment input device configured to receive an adjustment input and cause fluid to flow from either of the inner reservoir or the outer reservoir to the other based on the adjustment input.

6. The exercise machine assembly according to claim 5, wherein the adjustment input device is further configured to accept the adjustment input from a user.

7. The exercise machine assembly according to claim 5, wherein the adjustment input device includes an adjustment knob.

8. The exercise machine assembly according to claim 2, wherein the adjustment assembly includes an adjustment gate positioned substantially within the inner reservoir and configured to adjustably open or close any of the one or more openings.

9. The exercise machine assembly according to claim 8, wherein the adjustment gate is further configured to form a plurality of distinct flow configurations, each flow configuration representing a specific arrangement of the one or more openings being either opened or closed.

10. The exercise machine assembly according to claim 8, wherein the adjustment assembly includes an electrical actuator coupled to the adjustment gate and configured to rotatably drive the adjustment gate, the rotation of the adjustment gate determining whether any of the one or more openings are opened or closed.

11. The exercise machine assembly according to claim 10, wherein the adjustment assembly includes an adjustment input device coupled to the electrical actuator, the adjustment input device configured to receive an adjustment input and activate the electrical actuator based on the adjustment input, thereby causing the rotation of the adjustment gate.

12. The exercise machine assembly according to claim 8, wherein the adjustment assembly includes an adjustment input device coupled to the adjustment gate, the adjustment input device configured to receive an adjustment input and adjust the adjustment gate based on the adjustment input.

13. The exercise machine assembly according to claim 8, wherein the adjustment assembly includes an adjustment rod coupled to the adjustment gate and configured to rotatably drive the adjustment gate, the rotation of the adjustment gate determining whether any of the one or more openings are opened or closed.

14. The exercise machine assembly according to claim 13, wherein the adjustment assembly includes a hollow fluid displacement device shaft that is connected to the fluid displacement device, and the adjustment rod longitudinally traverses an interior of the fluid displacement device shaft.

15. The exercise machine assembly according to claim 13, wherein the adjustment assembly includes an adjustment input device coupled to the adjustment rod, the adjustment input device configured to receive an adjustment input and rotatably drive the adjustment rod based on the adjustment input, thereby causing the rotation of the adjustment gate.

16. The exercise machine assembly according to claim 1, wherein the fluid container and the fluid displacement device are horizontally oriented with respect to the exercise machine assembly.

17. The exercise machine assembly according to claim 1, wherein the fluid displacement device includes a paddle.

18. The exercise machine assembly according to claim 1, wherein the exercise machine assembly includes a rowing machine.

19. A method, comprising:

providing an exercise machine assembly configured to provide a fluid-based resistance force and allow a user to exert a force against the resistance force, the exercise machine including: i) a fluid displacement device and configured to be rotatably driven by the force exerted by the user, and ii) a fluid container having a hollow body enclosing the fluid displacement device, allowing for the fluid displacement device to rotate therein, and configured to enclose a fluid;

receiving an adjustment input at an adjustment input device, the adjustment input indicating a desired resistance level; and in response to the adjustment input, causing fluid to flow from an inner reservoir in the fluid container to an outer reservoir in the fluid container through one or more openings formed in the inner reservoir so as to achieve the desired resistance level, wherein during operation of the exercise machine assembly, the fluid displacement device displaces fluid in the outer reservoir, causing the fluid in the outer reservoir to separate from the inner reservoir, such that the fluid cannot flow from the outer reservoir to the inner reservoir.

* * * * *